US006243015B1

(12) United States Patent
Yeo

(10) Patent No.: US 6,243,015 B1
(45) Date of Patent: Jun. 5, 2001

(54) DRIVER'S DROWSINESS DETECTION METHOD OF DROWSY DRIVING WARNING SYSTEM

(75) Inventor: Jung-hack Yeo, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/334,960

(22) Filed: Jun. 17, 1999

(51) Int. Cl.[7] ..... G08B 23/00

(52) U.S. Cl. ..... 340/576; 340/575; 382/117; 382/118

(58) Field of Search ..... 340/576, 575, 340/573.1; 180/272; 348/789; 382/117, 118

(56) References Cited

U.S. PATENT DOCUMENTS 5,570,698 * 11/1996 Liang et al. ..... 340/575
5,729,619 * 3/1998 Puma ..... 382/115
5,805,720 * 9/1998 Suenaga et al. ..... 382/117
5,859,921 * 1/1999 Suzuki ..... 382/118
5,878,156 * 3/1999 Okumura ..... 382/118

* cited by examiner

*Primary Examiner*—Jeffery Hofsass
*Assistant Examiner*—John Tweel, Jr.
(74) *Attorney, Agent, or Firm*—Christie, Parker & Hale, LLP

(57) ABSTRACT

A driver's drowsiness detection method of a drowsy driving alarming system comprising the steps of: determining a vertical width of a driver's eye from a driver's face image input from a CCD camera, presetting a standard vertical width and a standard drowsiness factor on the basis of the average vertical width of the driver's eye, comparing a real vertical width of the driver's eye with the standard vertical width, increasing or decreasing a drowsiness factor depending on the vertical width of the driver's eye, and judging whether the driver is drowsy or not by comparing the drowsiness factor increased or decreased to the standard drowsiness factor.

2 Claims, 2 Drawing Sheets

DRIVER'S DROWSINESS DETECTION METHOD OF DROWSY DRIVING WARNING SYSTEM

BACKGROUND OF THE INVENTION (a) Field of the Invention

The present invention relates to a drowsy driver warning system and, more particularly, to the driver's drowsiness detection method for determining whether driver is drowsy or not.

(b) Description of the Related Art

Recently, much research and development has been conducted on the advanced safety vehicle (ASV) for preventing road accidents and minimizing damage when collisions occur. The basic concept of the ASV is a safety-guaranteed and accident-preventive vehicle. To achieve these objectives, many safety technologies are adapted in the ASV. These technologies includes a drowsy driving warning system, a nighttime pedestrian monitoring and warning system, a fire alarm system, and so on.

Among them, the drowsy driving warning system helps prevent accidents caused by a drowsy driver at the wheel by means of sounding an alarm, shaking the seat, increasing the audio volume, or emitting a strong stimulating gas. Thus, prior to activating an alarm, there is needed to detect the driver's condition as to whether or not he is drowsy, by analyzing his face image and signals from electrical switches such as a brake switch, a directional signal switch, a wiper switch, and so on.

In such a drowsy driving warning system, image-processing technology is used to analyze the driver's face image, particularly his eyes, taken with a charge-coupled device (CCD) camera. If the driver's eyes are frequently kept closed over a predetermined period, a drowsiness detection unit determines that the driver is drowsy so as to sound an alarm.

In the prior art, since the driver's condition is determined by simple drowsiness factor on the basis of the duration and frequency of the closing of the driver's eyes, the reliability of the driver's condition assessment deteriorates if there is noise in the driver's face image data.

SUMMARY OF THE INVENTION

The present invention has been made in an effort to solve the above problems.

It is an object of the present invention to provide a method for accurately detecting the driver's condition on the basis of the driver's eye closing/opening without interference from exterior noise.

To achieve the above object, a driver's drowsiness detection method according to the present invention comprises the steps of determining a vertical width of a driver's eye from a driver's face image input from a CCD camera, presetting a standard vertical width and a standard drowsiness factor on the basis of the average vertical width of the driver's eye, comparing an actual vertical width of the driver's eyes with the standard vertical width, increasing or decreasing a drowsiness factor depending on the vertical widths of the driver's eyes, and determining as to whether the driver is drowsy or not by comparing the drowsiness factor increased or decreased to the standard drowsiness factor.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described in detail with reference to the accompanying drawings.

Figure 1:
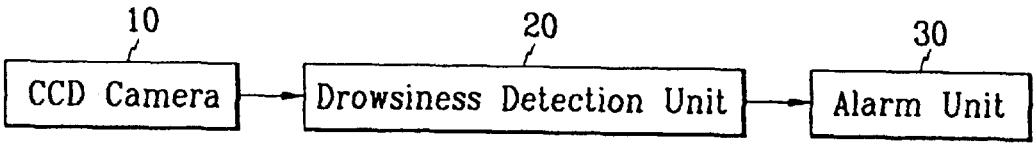
FIG. 1 is a block diagram illustrating a structure of a driver's drowsiness detection apparatus according to a preferred embodiment of the present invention.

FIG. 1 is a block diagram that shows a structure of the driver's drowsiness detection system according to the preferred embodiment of the present invention. As shown in FIG. 1, the driver's drowsiness detection system comprises a CCD camera 10 for taking an image of the driver's face, a drowsiness detection unit 20, and an alarm unit 30.

The CCD camera 10 monitors the driver's face and sends continuously captured image signals to the drowsiness detection unit 20. The drowsiness detection unit 20 analyzes the image signals and calculates a drowsiness factor so as to determine whether the driver is drowsy or not on the basis of calculated drowsiness factors. The alarm unit 30 raises an alarm according to the signal from the drowsiness detection unit 20 to awaken the driver.

An drowsiness detection method according to the preferred embodiment of the present invention will now be described with reference to the accompanying drawings.

Figure 2:
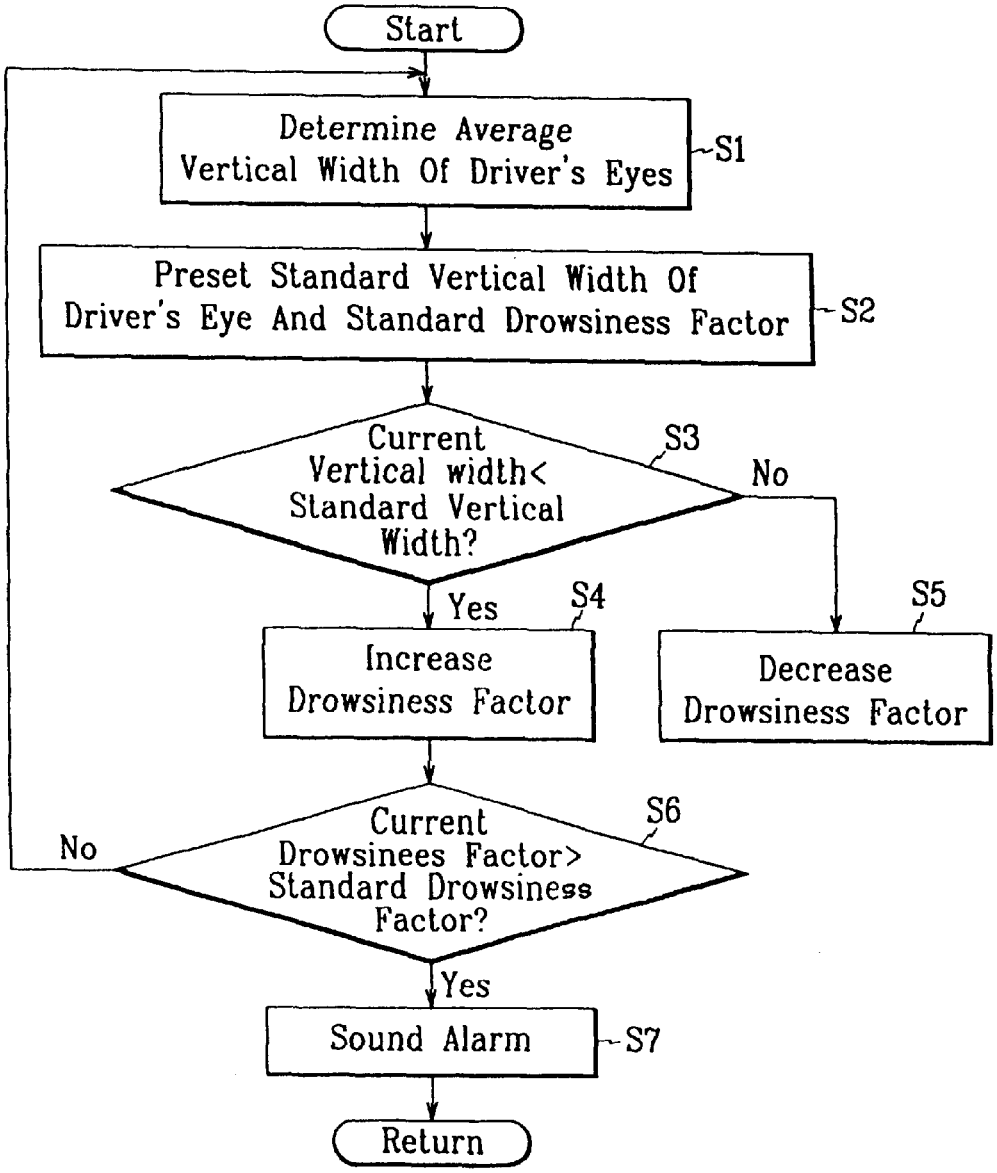
FIG. 2 is a flow chart illustrating the driver's drowsiness detection method according to the preferred embodiment of the present invention.
Figure 3:
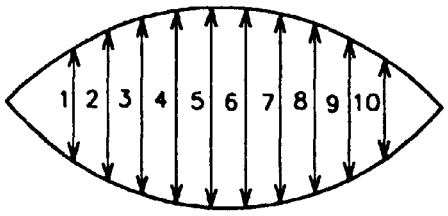
FIG. 3 is a schematic sketch of an eye for calculating the vertical width of the eye.
Figure 4:
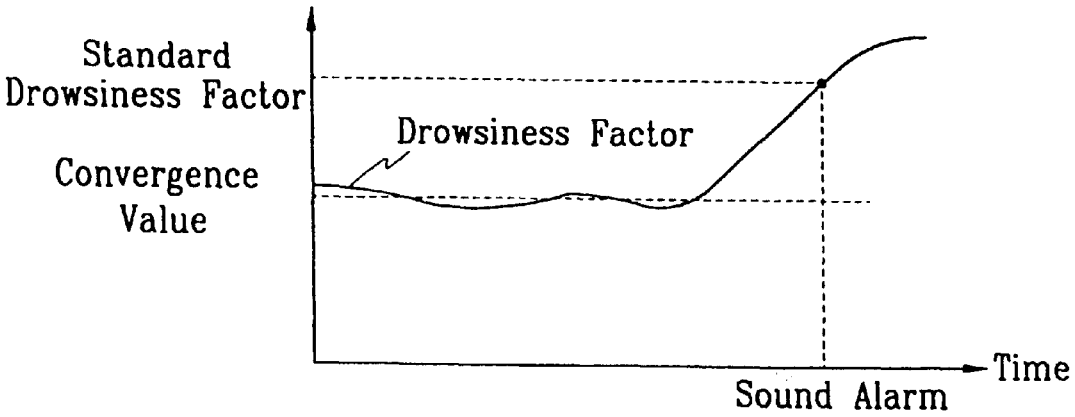
FIG. 4 illustrates the behavior of drowsiness factor calculated according to the preferred embodiment of the present invention.

FIG. 2 shows a flow of the drowsiness detection method, FIG. 3 shows an eye separated for averaging vertical width of the driver's eye, and FIG. 4 shows a behavior of drowsiness factor according to the preferred embodiment of the present invention.

The driver's face image taken with the CCD camera 10 is input to the drowsiness detection unit 20 in gray scale and the gray scale image is binarized by means of threshold filtering in which pixels having black level similar to that of eyes are designated as "1"s and the other pixels are designated as "0"s. Then, according to step S1 of FIG. 2, the drowsiness detection unit 20 determines a vertical width ($1\infty10$) of an driver's eye by averaging the vertical widths of several parts of one eye as shown in FIG. 3 and then determines the average vertical width of the driver's eye by averaging the vertical widths of the driver's eye detected over a predetermined period.

Next in step S2, the drowsiness detection unit 20 presets a standard vertical width of the driver's eye for use as a basis to determine whether the eye is opened or closed and standard drowsiness factor for using a basis to determine whether the driver is drowsy or not in step S2. Next in step S3, the drowsiness detection unit 20 calculates the current vertical width of the driver's eye and compares the present calculated vertical width to the standard vertical width. If the present vertical width is less than the standard vertical width, the drowsiness detection unit 20 increases the drowsiness factor on the basis of the below equation 1, and if the present vertical width is greater than the standard vertical width, the drowsiness detection unit 20 decreases the drowsiness factor on the basis of the below equation 2:

$$\text{Drowsiness Factor}|_{new}=\text{Drowsiness Factor}|_{old}\times(1-0.05)+0.05 \quad \text{Equation 1:}$$

$$\text{Drowsiness Factor}|_{new}=\text{Drowsiness Factor}|\text{old}\times 0.95 \quad \text{Equation 2:}$$

Since the drowsiness factor is increased or decreased according to the vertical width of the driver's eye, the drowsiness factor converges to a predetermined value when the driver is blinking normally.

Furthermore, even if the standard vertical width of the driver's eye is preset extremely narrow or wide due to bad image data with noise, the drowsiness factor does not vary abruptly.

Whenever the driver is so drowsy that his eyes stay closed over a predetermined period, the drowsiness factor increases slowly on the basis of the equation 1. As shown in FIG. 4, if the drowsiness factor increases to greater than a predetermined standard drowsiness factor in step S6, the drowsiness detection unit 20 sends a signal to the alarm unit 30 so as the alarm unit 30 to alarm in step S7.

In this preferred embodiment of the present invention, the driver's condition as to whether he is drowsy or not can be accurately determined by preventing incorrect determination caused by noise in the face image. Accordingly, the reliability on drowsiness detection is enhanced.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A method for detecting a driver's drowsiness comprising the steps of:

detecting an average vertical width of a driver's eye from a driver's face image;

determining a standard vertical width and a standard drowsiness factor on the basis of the average vertical width of the driver's eye, wherein the average vertical width is determined by averaging the vertical width of several parts of the drivers eye over a predetermined period of time;

comparing a current vertical width of the driver's eye with the determined standard vertical width;

determining a current drowsiness factor wherein, if the current vertical width of the driver's eye is less than the standard vertical width, the drowsiness factor is calculated on the basis of the following equation:

$$\text{Drowsiness Factor}_{(new)}=\text{Drowsiness Factor}_{(old)}\times(1-0.05)+0.05;\text{ and}$$

comparing the current drowsiness factor with the determined standard drowsiness factor.

2. A method for detecting a driver's drowsiness comprising the steps of:

detecting an average vertical width of a driver's eye from a driver's face image;

determining a standard vertical width and a standard drowsiness factor on the basis of the average vertical width of the driver's eye, wherein the average vertical width is determined by averaging the vertical width of several parts of the drivers eye over a predetermined period of time;

comparing a current vertical width of the driver's eye with the determined standard vertical width;

determining a current drowsiness factor wherein, if the current vertical width of the driver's eye is greater than the standard vertical width, the drowsiness factor is calculated on the basis of the following equation:

$\text{Drowsiness Factor}_{(new)}=\text{Drowsiness Factor}_{(old)}\times 0.95$; and comparing the current drowsiness factor with the determined standard drowsiness factor.

* * * * *